US005992100A

United States Patent [19]

Sidney

[11] Patent Number: 5,992,100

[45] Date of Patent: Nov. 30, 1999

[54] DOOR JAMB ASSEMBLY

[76] Inventor: Kenneth James Sidney, P.O. Box 676, Ballina, NSW 2478, Australia

[21] Appl. No.: 08/983,259

[22] PCT Filed: Jul. 11, 1996

[86] PCT No.: PCT/AU96/00438

§ 371 Date: Jan. 9, 1998

§ 102(e) Date: Jan. 9, 1998

[87] PCT Pub. No.: WO97/03269

PCT Pub. Date: Jan. 30, 1997

[30] Foreign Application Priority Data

Jul. 11, 1995 [AU] Australia ..... PN4065

[51] Int. Cl.[6] ..... E06B 3/00

[52] U.S. Cl. ..... 49/505

[58] Field of Search ..... 49/505, 504; 52/210, 52/217

[56] References Cited

U.S. PATENT DOCUMENTS

| | | | |
|---|---|---|---|
| 1,718,813 | 6/1929 | Finley | 49/505 |
| 1,750,921 | 3/1930 | Bright | 52/217 |
| 1,919,393 | 7/1933 | Reinhardt | 52/217 |
| 2,443,548 | 6/1948 | Wilson | 52/217 X |
| 2,481,721 | 9/1949 | Carper | 49/505 |
| 2,661,084 | 12/1953 | Steffan | 49/505 |
| 2,699,578 | 1/1955 | Marks | 49/505 X |
| 2,859,491 | 11/1958 | Morris, Jr. . | |

FOREIGN PATENT DOCUMENTS

| | | | |
|---|---|---|---|
| 37301/50 | 12/1950 | Australia | E05B 15/02 |
| 22809/92 | 3/1993 | Australia | E06B 1/18 |
| 2015149 | 10/1971 | Germany . | |
| 2015150 | 11/1971 | Germany . | |
| 2025004 | 12/1971 | Germany . | |

*Primary Examiner*—Jerry Redman

*Attorney, Agent, or Firm*—Caesar, Rivise, Bernstein, Cohen, & Pokotilow, Ltd.

[57] ABSTRACT

A door jamb assembly (10) for a door (13) having a lock (17), the jamb assembly (10) including a movable side jamb member (14) which is mounted for movement laterally of the door (13) and between a first position adjacent the door (13) to enable the lock bolt (16) of the door lock (17) to engage a striker plate (15) carried by the jamb member (14) and a position where the jamb member (14) moves the striker plate (15) free of the lock bolt (16) to enable the door (13) to be opened without release of the lock (17).

14 Claims, 6 Drawing Sheets

DOOR JAMB ASSEMBLY

TECHNICAL FIELD

This invention relates to an improved door jamb assembly.

BACKGROUND ART

Door jamb assemblies of many different types and styles are currently available. In the case of hinged doors, the door jamb assembly is formed about or mounted into a door opening during construction of a building and remains fixed in position to support a door and also provide a hinge mount for a door. In addition, one of the door jambs normally supports a striker plate or equivalent device for one or more door locks. Door stops are provided around the jambs against which the door abuts or lies adjacent when the door is closed. With the awareness of increasing security in the home, sophisticated and more secure locking systems have been introduced to lock doors, particularly outside or entry doors, in a secure manner. Often such locks incorporate a number of locking bolts. Similar secure locking systems are provided where security screens are used adjacent a door jamb. Another common security lock which is available comprises a chain which is fixed to a door jamb on the inner side of the door opening and which is releasably attachable to the door to limit opening of the door from the outside when the normal door lock is released.

Whilst such locking systems provide the required level of security to prevent or deter entry into a building from the outside, they usually do not allow rapid opening of the door from the inside. This can cause difficulties and problems where, for example rapid escape from a building is required. Such a situation may arise where a fire occurs within a building. It is not unknown for persons to be trapped in a building because they are unable to rapidly escape through the external door or doors due to the complexity and security of the locking system.

The present invention aims to overcome or alleviate the above disadvantages by providing a door jamb assembly for use with an entry door, screen door or any other door which enables a person to rapidly unlock or render ineffective the normal door locking devices from the side of the door opening opposite the normally locked side. The present invention also aims to provide a system which is relatively simple and which may be incorporated into an existing door jamb assembly or which may be supplied in a new door jamb assembly. Other objects and advantages of the invention will become apparent from the following description.

SUMMARY OF THE INVENTION

The present invention thus provides in a preferred form a door jamb assembly for a door having a door lock, said door jamb assembly having at least upright one door jamb member, means for supporting said door jamb member for movement between a first attitude for engagement by said door lock for locking of said door in a closed attitude, and means for selectively moving said jamb member to a second attitude away from said first attitude and free of said door lock to permit opening of said door.

The door jamb may carry a striker plate or equivalent device for engagement by the bolt of the door lock for locking of the door, In one arrangement the door jamb member may be supported for movement laterally in parallelism towards and away from the side edge of the door carrying the door lock and associated bolt. For this purpose, the door jamb member may be supported by parallel links which are pivotally mounted to the door jamb and a fixed frame member and which may be pivoted to move the jamb member away from the edge of the door.

The means for selectively moving the jamb member suitably are in the form of actuating means which are accessible from the inside of the door opening. The actuating means may be coupled to the links and may be operated from one side of the door opening, normally the inner side to effect or allow movement of the jamb member and permit opening of the door. The actuating means may be in the form of a pivotal lever arm.

Alternatively, the door jamb member may be supported for sliding movement towards and away from the adjacent side edge of the door, for example on guide pins. Biasing means such as springs may be provided for normally biasing the door jamb to a retracted position in which the lock bolt is disengaged from the striker plate. Means may be provided to urge the door jamb member into a position adjacent the door to enable the lock to be effective. Such means may comprise cam means which when moved, for example when rotated, may permit the door jamb member o retract and the latch bolt to be disengaged from the striker plate to allow for door opening.

The door jamb in this form may be defined by a first upright member which may be fixed in or adjacent a door opening and a movable "false" door jamb member supported for movement relative to the fixed member, the movable door jamb carrying the lock striker plate. The upright member may be hollow to receive the movable door jamb member.

In an alternative arrangement, the jamb member may be supported for pivotal movement about a substantially vertical axis so as to pivotable away from its first attitude in which the door may be locked and a release position permitting the door to be opened without release of the lock. Various different actuating means may be providing for moving or allowing movement of the jamb member.

The door may be provided with hinges which allow hinged movement of the door in two directions from a closed position. Thus assuming that the door is an external door of a building the arrangement is such that when the moveable jamb member is moved to release the door lock, the door may be pushed outwardly about its hinge axis from the inside to allow rapid escape from the building. To achieve this movement the door jamb assembly may be provided with door stops which do not prevent outward movement of the door. For this purpose the door stops at the hinge side of the door and top of the door may be in the form of seals which may be deflected or compressed when the door is pushed towards an open attitude from the inside to allow the door to open.

The door stop adjacent to the door lock is moved clear of the door lock when the movable door jamb is moved as described.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE EMBODIMENTS

Figure 1:
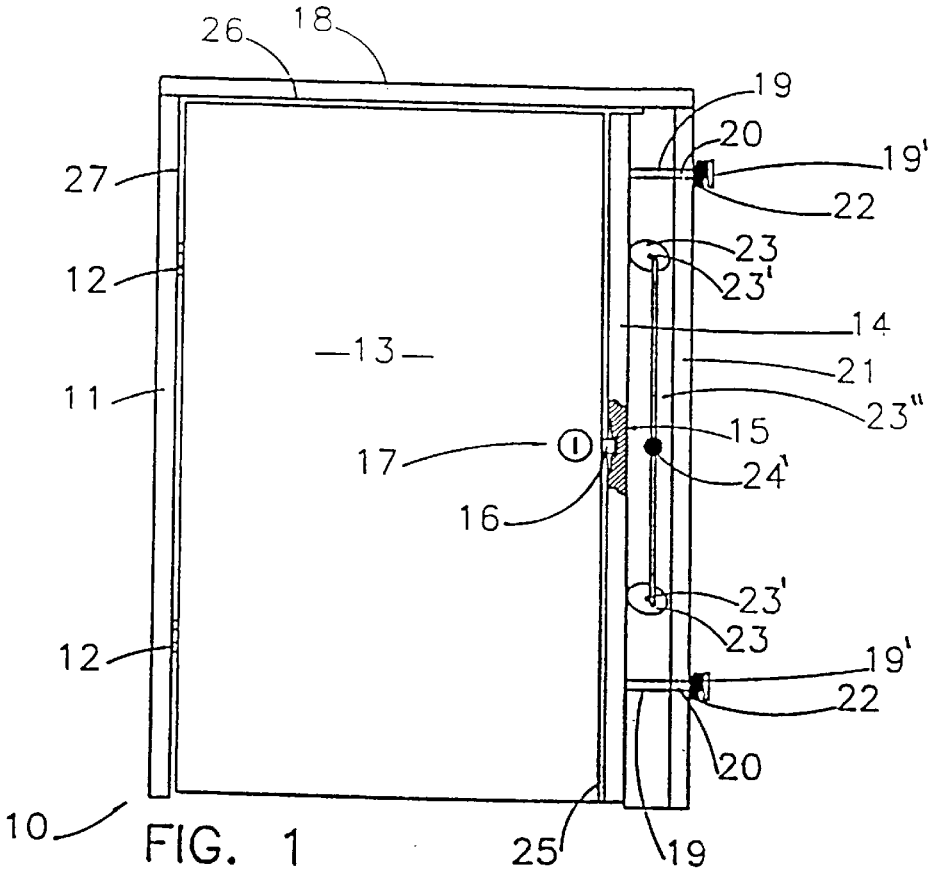
FIG. 1 is a schematic view of a door jamb assembly according to the present invention with a door mounted therein.

Referring to the drawings and firstly to FIG. 1 there is illustrated a door jamb assembly 10, including a first upright fixed side jamb 11 which hingedly supports through spaced hinges 12, a door 13, an opposite upright side jamb 14 which may carry a lock striker plate 15 or equivalent device to receive the locking bolt 16 of a door lock 17 mounted on the door 13, and a head jamb 18.

In accordance with a first embodiment of the invention, the door jamb 14 is supported by pins 19 for slidable movement towards and away from the edge of the door 13 with movement of the jamb 14 being effected or allowed by cams or other actuating mechanism. The pins 19 are rigidly fixed to the jamb 14 and pass through apertures or bores 20 in an upright frame member 21 arranged rearwardly of, and substantially parallel to the jamb 14, the member 21 being fixedly mounted in or adjacent a door opening. The pins 19 may be spring loaded by springs 22 to a retracted position to normally retract the door jamb 14 towards the frame member 21 and for this purpose, the pins 19 have heads 19' at their free ends and the springs 22 are located between the heads 19' and member 21 to normally retract the pins 19.

Figure 2:
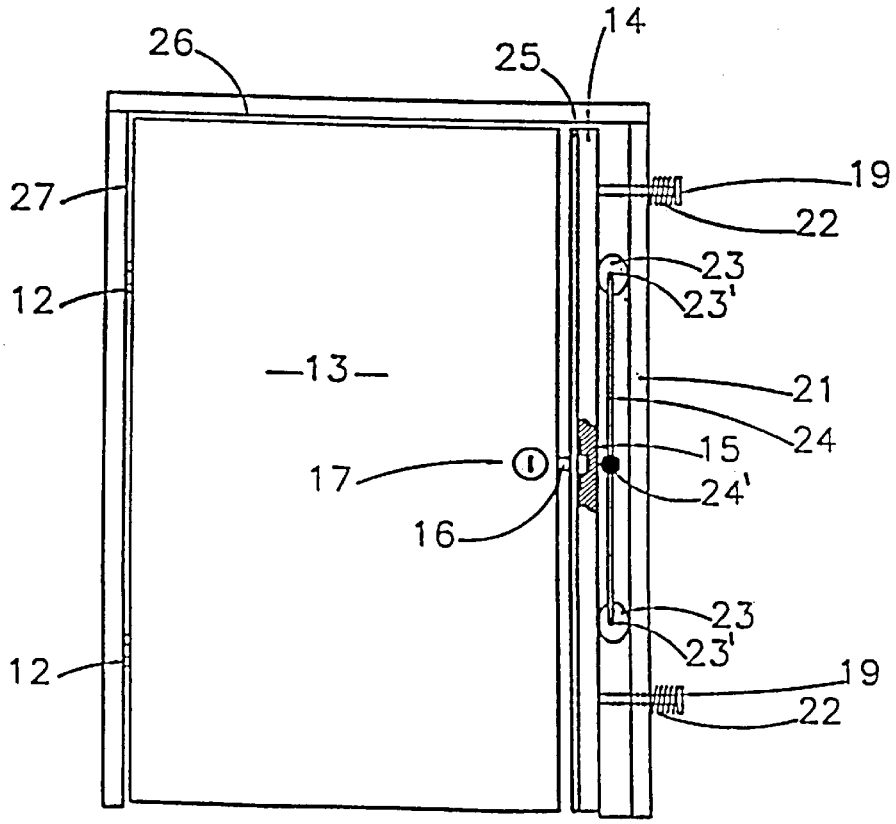
FIG. 2 is a view showing the released attitude of the door jamb assembly of FIG. 1.

The jamb 14 is urged to a normal operative position against the force of the springs 22 by means of a cam or cams 23 which when rotated in one direction, in this case clockwise, allows the spring force of the springs 22 to retract the jamb 14 to the position of FIG. 2. The cams 23 are pivotally mounted at 23' to a fixed side frame or facing member 23" for movement about substantially horizontal axes and may be coupled together by a common actuating member 24 capable of being actuated from the inside of the door 13. The member 24 is pivotally connected at its opposite ends to each cam 23 and an actuating handle 24' is connected to the member 24 for effecting movement thereof. Thus when the member 24 is moved by the handle 24' upwardly, the cams 23 will rotate allowing the springs 22 to retract the door jamb 14 as shown in FIG. 2. In this position it will be seen that the lock bolt 16 is moved clear of the striker plate 15 allowing the door 13 to be opened without unlocking the lock 17 or withdrawing the lock bolt 16.

An alternative release mechanism may comprise simple locking pins which hold the jamb 14 in the extended operative position of FIG. 1, the pins being releasable such that the jamb 14 under the influence of the springs 22 may rapidly retract to the release position of FIG. 2.

The door jamb assembly 10 is provided along the jamb 14 with a conventional door stop 25 against which the door 13 abuts or adjacent to which the door 13 is located when the door 13 is closed. The conventional door stops at the head jamb member 18 and opposite side jamb member 11 are replaced in this instance by displaceable or deflectable seals 26 and 27 which will have the effect of co-operating with the door 13 when the door 13 is closed to seal the door 13 in its opening. The hinges 12 for the door 13 comprise two way hinges which permit the door 13 to be hingedly moved in either direction from its closed position.

Thus when the door jamb 14 is retracted the door stop 25 is similarly retracted a sufficient extent to be moved clear of the adjacent edge of the door 13 and the protruding lock bolt 16. A force may thus be applied to the door 13 to push the door open from the inside and allow for ready escape through the door opening. Alternatively the door 13 may be pulled open however in some circumstances this may prove difficult or impossible depending upon the conditions within the building.

Figure 3:
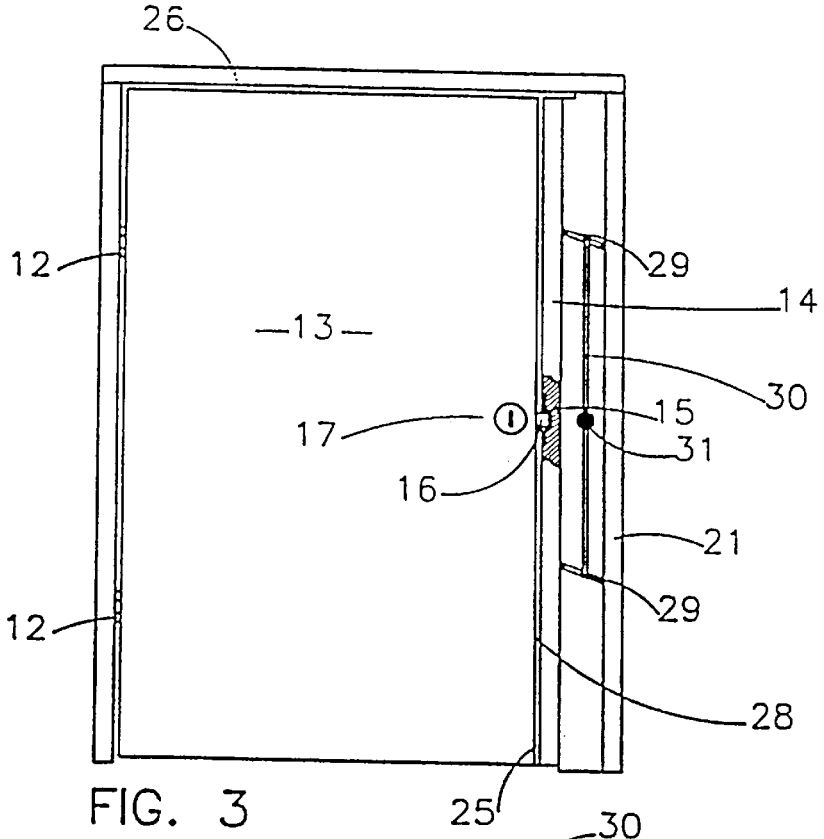
FIG. 3 illustrates a further form of door jamb assembly according to the invention.

In the embodiment of FIG. 3, the jamb 14 is supported for movement in parallelism towards and away from the edge 28 of the door 13 from which the lock bolt 16 may project. For this purpose, the jamb 14 may be supported by a pair of parallel links 29 which are pivotally mounted at each end at spaced apart positions to the jamb 14 and the fixed frame member 21. An actuating arm 30 is pivotally connected at each end to the links 29 and have an actuating handle 31 which is accessible on the inside of the building. In the normal position, the jamb 14 is located as shown in FIG. 3, such that the lock bolt 16 of the lock 17 may engage with the striker plate 15, with the door 13 locked in a conventional manner. If, however, rapid opening of the door 13 from the inside is required without unlocking the lock 17, the handle 31 may be grasped and elevated or moved such that the jamb 14 moves in parallelism away from the edge 28 of the door 13 until the bolt 16 is clear of the striker plate 15 and stop 25 as before. The door 13 may then be opened to allow escape through the door opening as described above.

Of course the jamb 14 may be mounted by many different means to achieve the required movement described above. For example, the jamb 14 may be mounted on rollers which are moveable in tracks such that the jamb 14 may be positioned adjacent the edge 28 of the door 13 to enable the lock 17 to operate normally or away from the door edge 28 which frees the lock bolt 16 from the striker plate 15 to allow the door 13 to be opened.

Figure 4:
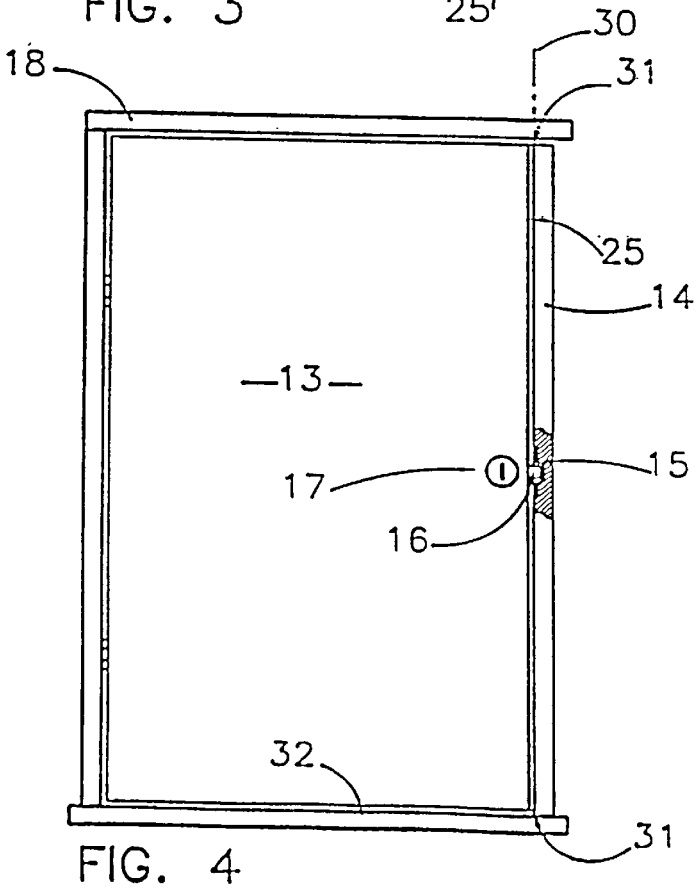
FIGS. 4 and 5 illustrate in elevational and plan an alternative form of door jamb and associated door according to the present invention.
Figure 5:
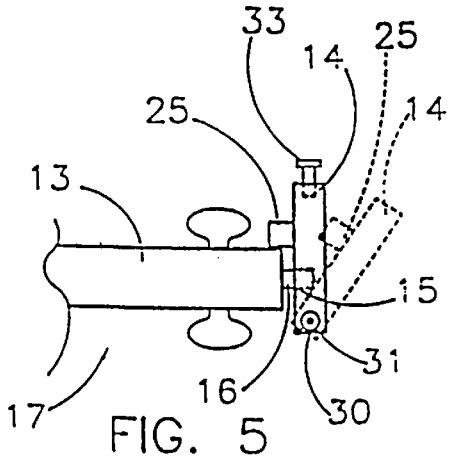

In yet an alternative arrangement shown in FIGS. 4 and 5, the jamb 14 is supported for pivotal movement about a substantially vertical axis 30 by means of pins 31 at its upper and lower ends which are received rotatably in openings in the head jamb 18 and foot 32, the pins 31 and thus the pivot axis 30 being located adjacent one side edge of the jamb 14 remote from the door stop 25. The jamb 14 is thus pivotally movable about the axis 30 in the manner shown in FIG. 5 to the position shown in dotted outline where the door latch bolt 16 is moved clear of the striker plate 15 and door stop 25. The door 13 may then be freely opened by pushing from the inside as indicated by the arrow shown in FIG. 5. This arrangement however is usually only suitable for situations where the door is to be opened to one side. The jamb 14 may be held in its normal position by a pin 33 extending through into the side of the jamb 14, the pin 33 when withdrawn permitting the jamb 14 to be moved to the position shown in dotted outline in FIG. 5.

Figure 6:
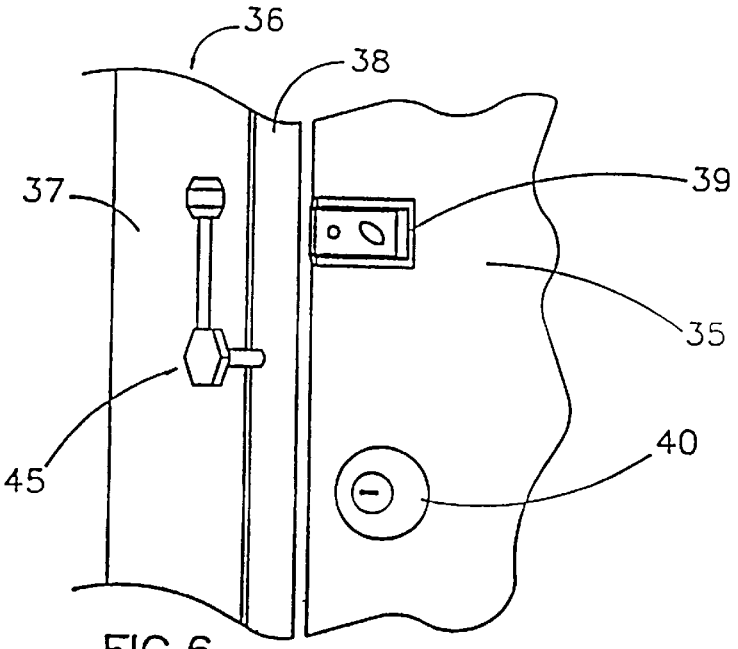
FIG. 6 illustrates a section of a door and door jamb assembly according to a further aspect of the invention with the door in a closed locked position.

Referring now to FIG. 6, there is illustrated section of a door 35 and door jamb assembly 36 according to a practical embodiment of the invention with the door 35 in a closed attitude. The door jamb assembly 36 includes a fixed outer hollow frame member 37 of U-shaped form and a movable jamb 38 which is capable of being retracted into the frame member 37. In this case, the door 35 includes a pair of locks 39 and 40 which normally lock the door 35 closed by having their respective lock bolts 41 and 42 extending into and engaged with striker plates 43 and 44 mounted on the movable jamb 38 (see FIG. 8). The door jamb assembly 36 also supports an actuating lever 45 which is pivotally mounted to the fixed frame member 37.

Figure 7:
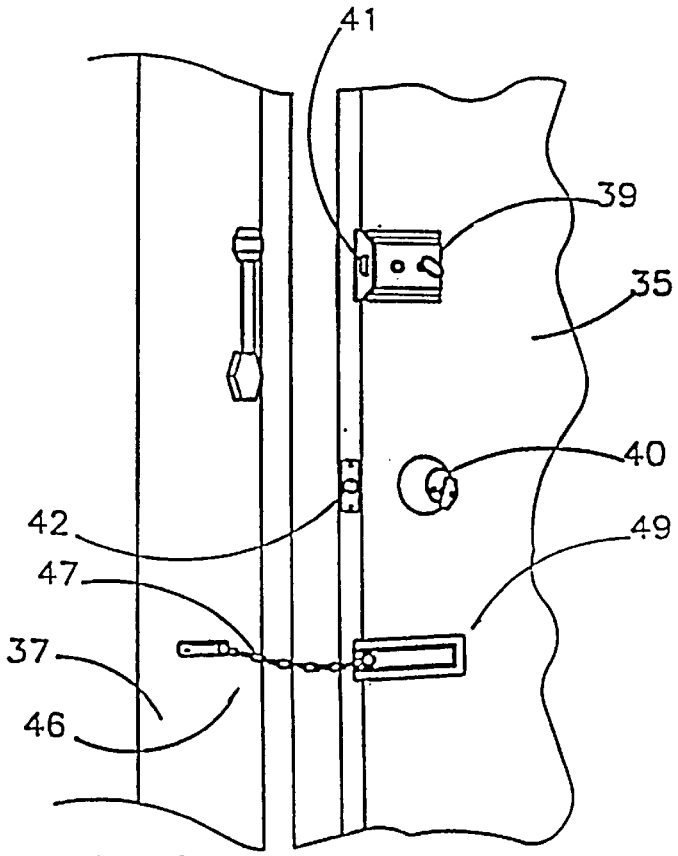
FIG. 7 illustrates the arrangement of FIG. 6 with the door partly opened inwardly.

The door 35 and jamb assembly 36 may be provided in this case with an additional security device 46 which comprises a chain 47 anchored at one end to the frame member 37 and being releasably engageable with a mount assembly 49 mounted on the door 35. This type of security device is in common usage and functions to prevent the door 35 being moved beyond a predetermined position when unlocked and opened inwardly as shown in FIG. 7.

Figure 8:
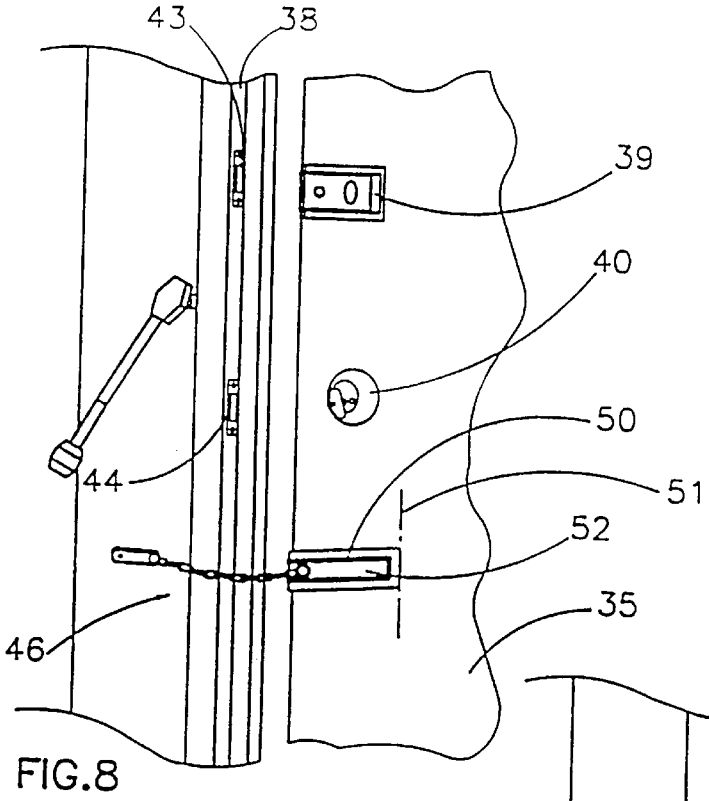
FIG. 8 illustrates the arrangement of FIG. 6 with the jamb retracted and the door partly opened outwardly.

In FIG. 8, the lever 45 is actuated by pivoting anticlockwise to cause the jamb 38 to be retracted into the hollow frame member 37 and thus away from the edge of the door 35 from which the lock bolts 41 and 42 project. This permits the door 35 to be pushed outwardly from the inside even though the locks 39 and 40 may be engaged with their associated striker plates 41 and 42 as the jamb 38 moves the striker plates 41 and 42 clear of the lock bolts of the locks 39 and 40. Movement of the door 35 outwardly however is prevented by the security device 46 thereby preventing rapid escape through the door opening.

Figure 9:
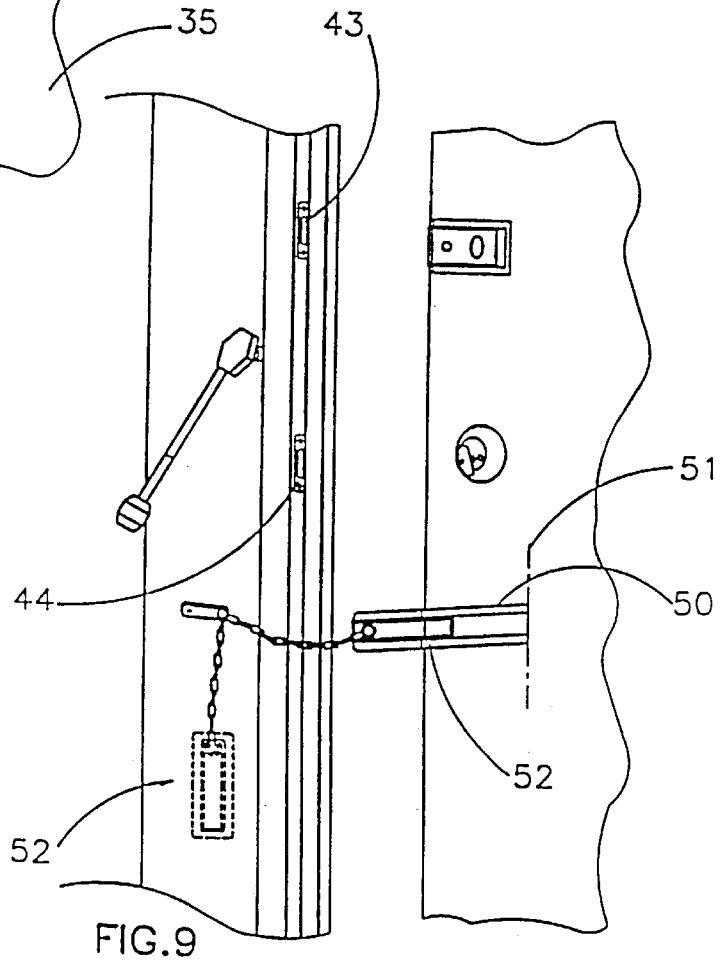
FIG. 9 illustrates the door opened further outwardly.

To overcome this disadvantage, the mount assembly 49 includes two parts, a first part 50 which is mounted for hinged movement to the door 35 at 51 for movement about a vertical pivot axis and a second part 52 which is sidably engaged with the first part 50, the first part 50 being of a channel shaped form for this purpose. Thus when the door 35 is pushed inwardly, the first part 50 of the mount assembly 49 will pivot outwardly of the door 35 about the axis 51. This will allow the second part 52 to slide outwardly of the first part 50 as shown in FIG. 9 and then become detached from the part 50 as shown in dotted outline to fully release the door 35 to allow it to be fully opened without restraint. The device 46 however functions in a normal manner if the door is opened normally, that is pivoted inwardly as shown in FIG. 7.

Figure 10:
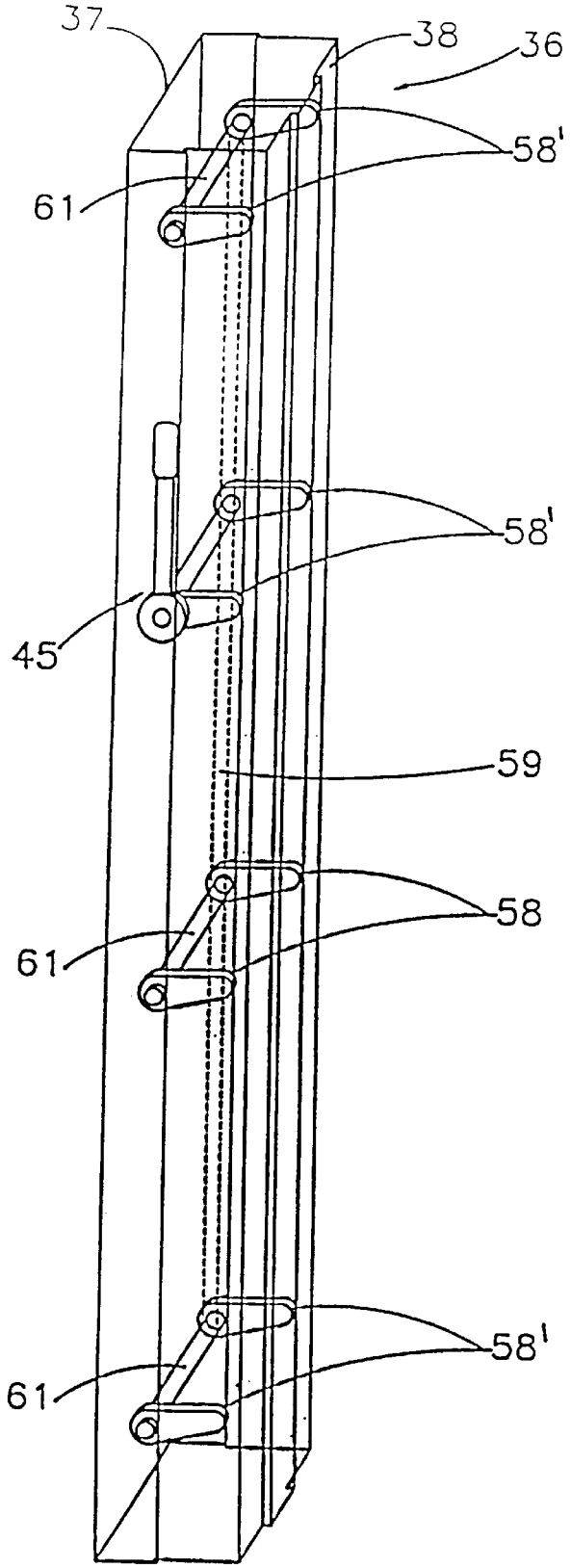
FIG. 10 illustrates the adjustable door jamb assembly.
Figure 11:
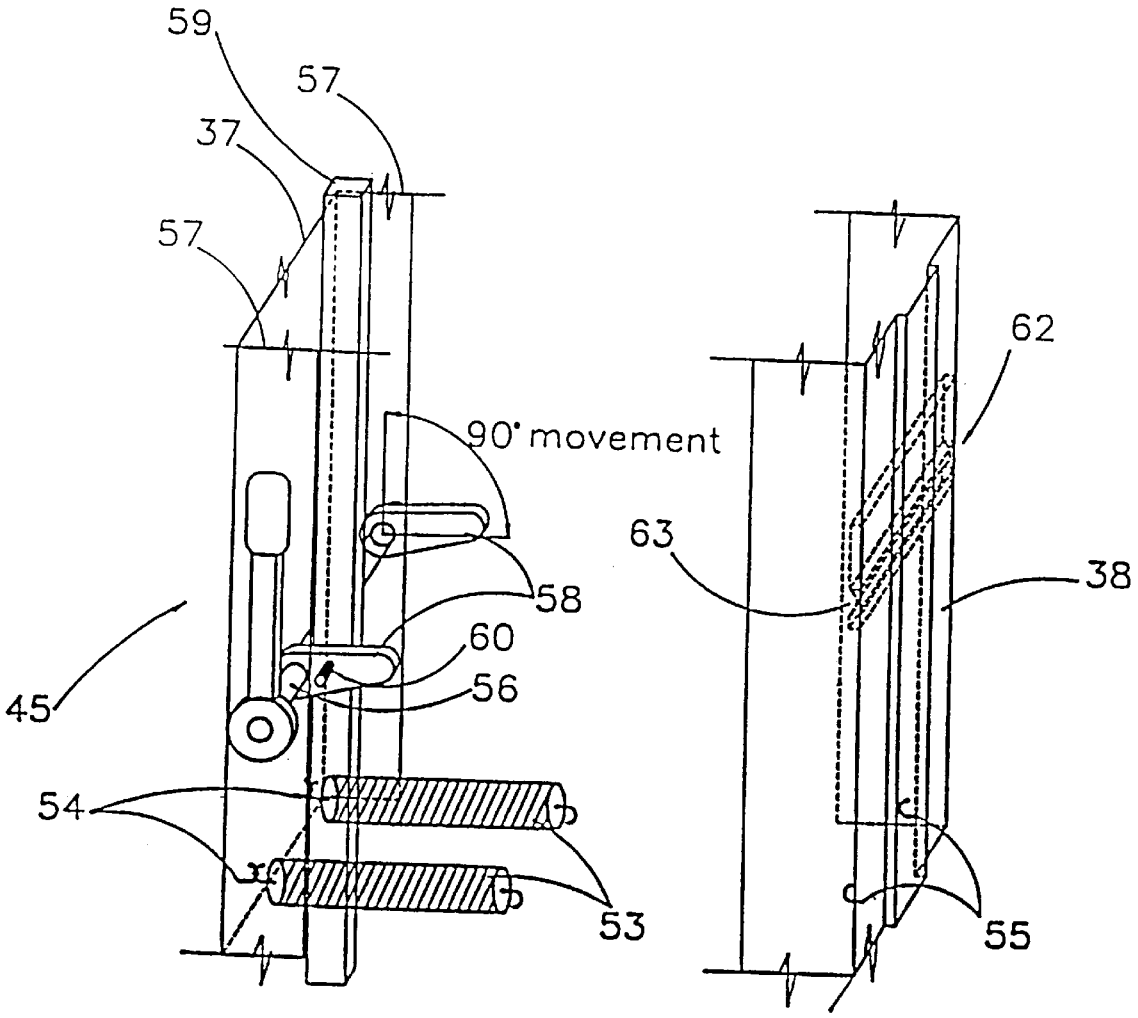
FIG. 11 illustrates in exploded view components of the door jamb assembly.

Further details of the door jamb assembly 36 are shown in FIGS. 10 and 11 where it will be apparent that the movable jamb 38 may move into the fixed U-shaped member 37. Springs 53 are provided to extend between the jamb 38 and frame member 37, being connected to the jamb 38 and member 37 by respective hooks 54 and 55 respectively, the springs 53 being tension springs serving to bias the jamb 38 to a retracted position. The handle 45 is fixed to an end of a shaft 56 mounted for rotation to the frame member 37 and extending between opposite flanges 57 thereof. Mounted for rotation with the shaft 56 are a pair of spaced cams 58 which in the position shown in FIGS. 10 and 11 urge the jamb 38 to its normal extended position. An actuating rod 59 is pivotally coupled at 60 to one of the cams 58 outwardly from the axis of rotation of the shaft 56 such that pivotal movement of the lever 45 in opposite directions will cause the actuating 59 to move vertically in opposite directions. The actuating rod 59 is also pivotally connected to further sets of cams 58' mounted on transverse shafts 61 at spaced positions along the member 37. The respective cams 58 are thus substantially parallel to each other and are moved simultaneously by the actuating rod 59 on actuation of the lever 45.

The movable jamb 38 may also include on its inner side detent plates 62 defining a transverse groove 63 for location of the cams 58 in the FIG. 11 position. The cams 58 being received in the grooves to provide a positive location of the cams 58 in the normal position. Similar plates 62 are provided on the member 38 opposite each set of cams 58 or 58'.

It will be apparent from FIGS. 10 and 11 that when the lever 45 is moved anticlockwise, the cams 58 and 58' will be rotated anticlockwise and moved free of the detent grooves 63. The bias of the springs 53 will thus cause the member 38 to retract into the U-shaped member 37 thereby freeing the striker plates 43 and 44 carried by the jamb 38 from the lock bolts 41 and 42 thereby allowing the door to open.

Many different arrangements may be provided for releasing the door jamb from its normal operative attitude to allow rapid opening of the door 13 or 35. Such arrangements may include levers, accessible by hand or by foot. In an alternative form, hydraulic actuators or electrical actuators may be provided for either releasing the jamb from its normal operative position, or for withdrawing the jamb from its normal operative position to allow opening of the door. Such arrangements may be controlled by switches or valves readily accessible from a position adjacent the door 13.

The jamb arrangement described above may be used with any form of door, including screen doors and security screen doors. Furthermore, whilst the invention is primarily related to hinge type doors, it may also be applied to other hinged closures and thus reference to door jamb assemblies in the specification also includes a reference to other similar closure assemblies, including windows or shutters.

Whilst the above has been given by way of illustrative embodiment of the invention, all such modifications and variations thereto as would be apparent to persons skilled in the art are deemed to fall within the broad scope and ambit of the invention as herein defined in the appended claims.

I claim:

1. A jamb assembly adapted for use with a closure having a lock that is movable between a first locking position and a second position, said jamb assembly having at least one upright jamb member, supporting means for supporting said jamb member for repetitive movement between first and second attitudes, and actuating means for selectively and repetitively moving said jamb member between said first and second attitudes independent of the position of the lock as desired, whereby said jamb assembly when used with a closure having a lock movable between a first locking position and a second position may be locked to said closure when said closure is in a closed position with said lock in the first locking position by positioning said jamb member in said first attitude and may be released from engagement with said closure to permit opening of said closure when said lock is in said first locking position by positioning said jamb member in said second attitude.

2. A jamb assembly according to claim 1 wherein said supporting maeans supports said jamb member for movement towards and away from a side edge of said closure, said side edge carrying said lock.

3. A jamb assembly according to claim 2 wherein said supporting means includes parallel links, said links being pivotally movable to move said jamb member towards and away from said edge of said closure.

4. A jamb assembly according to claim 3 wherein said actuating means pivotally moves said links.

5. A jamb assembly according to claim 4 wherein said actuating means are coupled to said links, said actuating means being located on one side of said jamb assembly.

6. A jamb assembly according to claim 2 wherein said supporting means supports said jamb member for sliding movement towards and away from said edge of said closure.

7. A jamb assembly according to claim 1 which includes biasing means for normally biasing said jamb member toward said second attitude.

8. A jamb assembly according to claim 7 which includes urging means to urge said jamb member against said biasing to said first attitude.

9. A jamb assembly according to claim 8 wherein said urging means comprises rotatable cam means, said cam means being rotatable to permit said jamb member to move to said first attitude under influence of said biasing means.

10. A jamb assembly according to claim 9 which includes a fixed upright member spaced from said jamb member and wherein said jamb member is supported to said fixed member.

11. A jamb assembly according to claim 10 wherein said fixed member is hollow and wherein said jamb member is receivable in said hollow fixed member.

12. A jamb assembly according to claim 1 wherein said jamb member is supported for pivotal movement about a substantially vertical axis so as to be pivotally movable between said first and second attitudes.

13. A jamb assembly according to claim 1 wherein said closure can be hingedly mounted to said jamb assembly for hinged movement in opposite directions from said closed position.

14. A jamb assembly according to claim 13 which includes sealing means for sealing said closure to said jamb assembly in said closed position, said sealing means being deflected or compressed when said closure is moved towards an open attitude.

* * * * *